US006865996B2

(12) United States Patent
Borrett

(10) Patent No.: US 6,865,996 B2
(45) Date of Patent: Mar. 15, 2005

(54) WATERJET CONTROL SYSTEM

(75) Inventor: John Robert Borrett, Christchurch (NZ)

(73) Assignee: CWF Hamilton & Co. Limited (NZ)

( * ) Notice: Subject to any disclaimer, the term of this patent is extended or adjusted under 35 U.S.C. 154(b) by 0 days.

(21) Appl. No.: 10/140,957

(22) Filed: May 8, 2002

(65) Prior Publication Data

US 2003/0019414 A1 Jan. 30, 2003

Related U.S. Application Data

(63) Continuation of application No. PCT/NZ00/00222, filed on Sep. 11, 2000.

(30) Foreign Application Priority Data

Nov. 9, 1999 (NZ) ..... 500928

(51) Int. Cl.[7] ..... B63H 25/00
(52) U.S. Cl. ..... 114/144 B; 440/41; 440/42
(58) Field of Search ..... 114/144 R, 144 B, 114/144 E, 151, 144 RE; 440/40–42

(56) References Cited

U.S. PATENT DOCUMENTS

| | | | |
|---|---|---|---|
| 3,918,256 | A | 11/1975 | Ashleman |
| 3,937,172 | A | 2/1976 | Castoldi |
| 3,942,464 | A | 3/1976 | Schoell |
| 3,976,023 | A | 8/1976 | Noguchi et al. |
| 4,026,235 | A | 5/1977 | Woodfill |
| 4,047,494 | A | 9/1977 | Scott |
| 4,073,258 | A | 2/1978 | Logan |
| 4,214,544 | A | 7/1980 | Dashew et al. |
| 4,220,111 | A | 9/1980 | Krautkremer et al. |
| 4,223,630 | A | 9/1980 | Keeney |
| 4,417,879 | A | 11/1983 | Kulischenko |
| 4,509,923 | A | 4/1985 | Turnbull |
| 4,519,335 | A | 5/1985 | Krautkremer et al. ..... 114/144 |
| 4,691,659 | A | 9/1987 | Ito et al. |
| 4,747,359 | A | 5/1988 | Ueno |
| 4,748,928 | A | 6/1988 | Nakamura |
| 4,915,049 | A | 4/1990 | Nakamura |
| 4,962,717 | A | 10/1990 | Tsumiyama |
| 4,992,065 | A | 2/1991 | Torneman et al. |
| 4,996,937 | A | 3/1991 | Niina et al. |
| 5,031,561 | A | 7/1991 | Nilsson |
| 5,050,518 | A | 9/1991 | Okita |
| 5,090,929 | A | 2/1992 | Rieben |
| 5,107,424 | A | 4/1992 | Bird et al. |
| 5,129,846 | A | 7/1992 | Dimijian |

(List continued on next page.)

FOREIGN PATENT DOCUMENTS

| | | |
|---|---|---|
| EP | 0035859 | 9/1981 |
| EP | 0778196 | 6/1997 |
| JP | 08020388 | 1/1996 |

OTHER PUBLICATIONS

Captain's Instruction, Styr–KontrollTeknik AB, dated Jul. 1994.

International Preliminary Examination Report for Application No. PCT/NZ00/00222 dated Mar. 6, 2002.

*Primary Examiner*—Ed Swinehart
(74) *Attorney, Agent, or Firm*—Dann, Dorfman, Herrell and Skillman, P.C.

(57) ABSTRACT

A dual axis joystick control system is used intuitively for maneuvring a waterborne vessel having two or more waterjets with steering deflectors (13) and reverse ducts (14) mounted independently of the steering deflectors. The joystick (21) is operated to actuate the reverse ducts of the port and starboard waterjets for either common or differential deflections of thrust, and to actuate the steering deflectors of the port and starboard waterjets for common deflections of thrust.

13 Claims, 5 Drawing Sheets

U.S. PATENT DOCUMENTS

| | | | | | |
|---|---|---|---|---|---|
| 5,235,927 | A | | 8/1993 | Singh et al. | |
| 5,240,444 | A | | 8/1993 | Kobayashi et al. | |
| 5,344,344 | A | | 9/1994 | Forsstrom | |
| 5,361,717 | A | | 11/1994 | Kobayashi | |
| 5,362,269 | A | | 11/1994 | Leach | |
| 5,395,272 | A | | 3/1995 | Smith | |
| 5,540,174 | A | | 7/1996 | Kishi et al. | |
| 5,603,644 | A | | 2/1997 | Kobayashi et al. | |
| 5,664,978 | A | | 9/1997 | Howe | |
| 5,707,264 | A | * | 1/1998 | Kobayashi et al. | 440/86 |
| 6,230,642 | B1 | | 5/2001 | McKenney et al. | |
| 6,234,100 | B1 | | 5/2001 | Fadeley et al. | |
| 6,234,853 | B1 | | 5/2001 | Lanyi et al. | |
| 2001/0029134 | A1 | * | 10/2001 | Moffet | 440/41 |

* cited by examiner

Jx = Joystick X axis signal
Jy = Joystick Y axis signal
F1 = RPM function
F2 = Reverse duct function
F3 = Steering deflector function

WATERJET CONTROL SYSTEM

FIELD OF THE INVENTION

This invention relates generally to control systems for waterborne vessels which are of propelled by waterjets. In particular but not solely the invention relates to systems for manoeuvring vessels having two or more waterjets with steering deflectors, and reverse ducts which are mounted independently of the steering deflectors. These systems enable use of a dual axis joystick controller to carry out a wide range of manoeuvres.

BACKGROUND OF THE INVENTION

A waterjet propulsion unit for a waterborne vessel produces thrust by way of a reaction to discharge of a high speed jet stream from an engine driven pump and nozzle arrangement. A steering deflector mounted at the outlet of the nozzle can direct the stream substantially laterally in relation to the longitudinal axis of the vessel to provide steering. A reverse duct mounted astern of the steering deflector can direct the stream substantially ahead along the longitudinal axis to provide reverse. One to four or more propulsion units may be installed across the stern according to size of a particular vessel or a configuration designed for the vessel. A bow thruster may also be used to assist some manoeuvres.

Engine power levels and the reverse ducts are conventionally controlled using lever systems which vary the ahead and astern thrust of each waterjet in both magnitude and direction. A single lever often controls both the throttle and the position of the duct. With the lever in a central position the engine idles and the duct is partially down to produce zero net thrust. Moving the lever forwards or backwards initially raises or lowers the duct at constant throttle, and then opens the throttle, to create a range of thrust levels directed ahead or astern. Separate levers may also control the throttle and duct for each unit although this can be cumbersome for the operator.

Steering may be controlled in various ways. Some waterjet units have independent steering deflectors and reverse ducts, in which case the steering deflectors on all of the units in an installation are generally controlled synchronously by way of a helm wheel or steering joystick. Other units have the reverse ducts mounted on the steering deflectors and their operation is not independent, in which case the steering deflectors on each of the waterjets in an installation may not be controlled synchronously. The control requirements of these two alternative systems are generally different.

Rotation and forward or backward translation of a vessel having multiple waterjet units is usually straightforward using existing control systems. However, a sideways manoeuvre into a berth for example, can be awkward or counterintuitive even for experienced operators. U.S. Pat. No. 5,031,561 describes a relatively complex system for a vessel having reverse ducts mounted on the steering deflectors. The system involves two modes in which the steering deflectors are operated synchronously when underway but differentially for many manoeuvres.

BRIEF SUMMARY OF THE INVENTION

It is an object of the present invention to provide control systems which are relatively simple and intuitive to use by operators of particular vessels propelled by waterjets, or at least to provide an alternative to existing systems. The invention generally involves provision of a dual axis joystick for control of reverse ducts on propulsion units in which the reverse ducts are mounted independently of the steering deflectors.

Accordingly in one aspect the invention may broadly be said to consist in a thrust control system for a water-borne vessel having port and starboard waterjet propulsion units comprising: thrust reverse means which determines respective deflections of thrust for the propulsion units, and first manual control means having two degrees of freedom which actuates the thrust reverse means to cause either common or differential deflections of thrust for the propulsion units.

Preferably the system includes thrust steering means which determines common deflections of thrust for the propulsion units, and second manual control means having one degree of freedom which actuates the thrust steering means. The system may also include a thrust power means which determines power levels for the propulsion units and which may also be actuated by the first manual control means. The manual controls and the means which they actuate may be provided in newly constructed vessels or as modules for upgrade of systems on existing vessels.

In a second aspect the invention may broadly be said to consist in a control system for a water-borne vessel having port and starboard waterjet propulsion units comprising: thrust power means which determines operational power levels for each of the propulsion units, thrust steering means which determines a common deflection of thrust for each of the propulsion units during all steering operations, thrust reverse means which determines further deflections of thrust separately for each of the propulsion units, first manual control means which actuates the thrust reverse means, second manual control means which actuates the thrust steering means, and third manual control means which actuates the thrust power means.

The invention also consists in any alternative combination of parts or features here described or shown in the accompanying drawings. All equivalents of these parts or features are included whether or not explicitly set out.

BRIEF DESCRIPTION OF THE DRAWINGS

Preferred embodiments of the invention will be described with respect to the accompanying drawings, of which.

DETAILED DESCRIPTION OF THE INVENTION

Referring to these drawings it will be appreciated that the invention can be implemented in a wide range of forms on a wide range of waterborne vessels. Details of the vessels, the individual control components and the propulsion units will be well known to a skilled reader and need not be given here.

Figure 1:
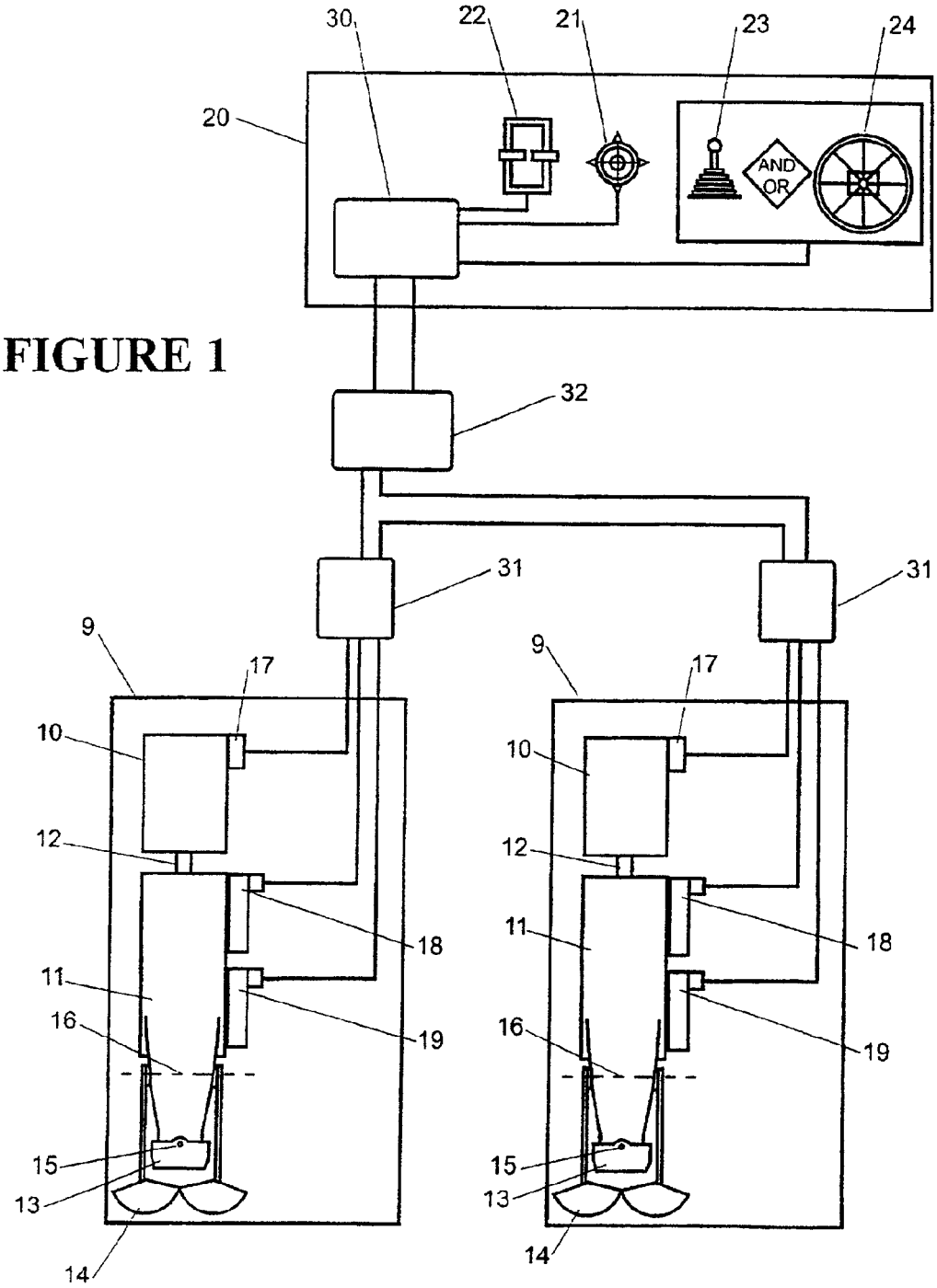
FIG. 1 schematically shows a possible arrangement of propulsion units and manual controls and control interfaces on a waterborne vessel, FIG. 2 indicates a range of fundamental manoeuvres which are possible with an arrangement of FIG. 1.
Figure 2:
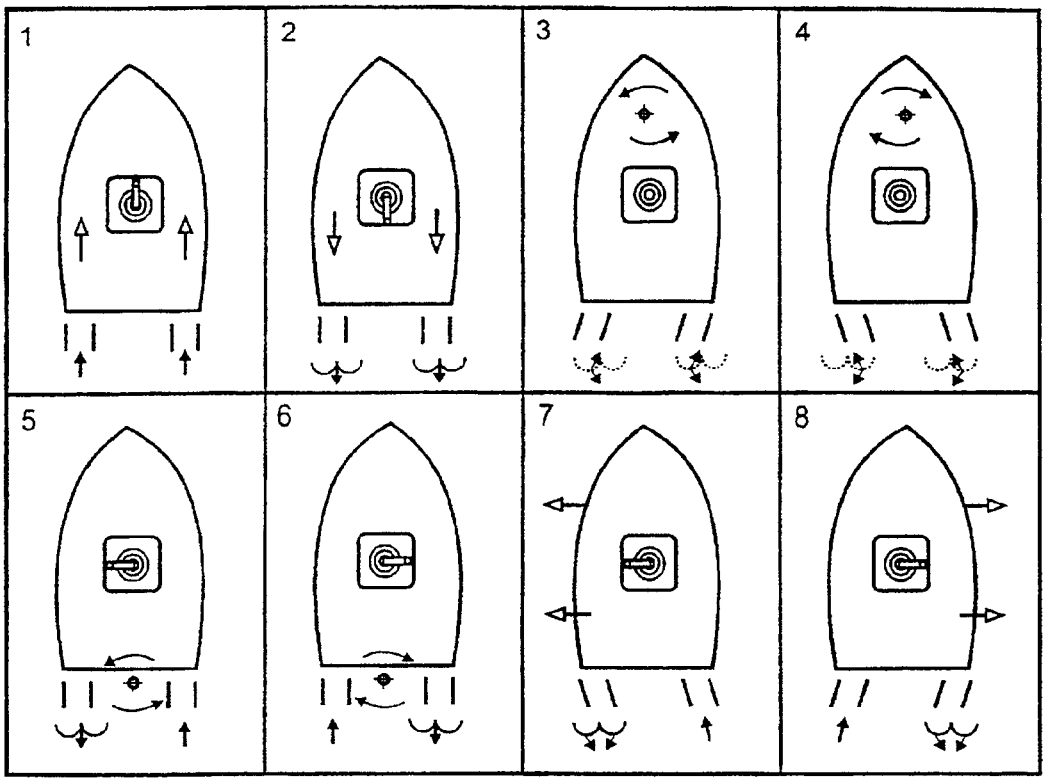
Figure 2:
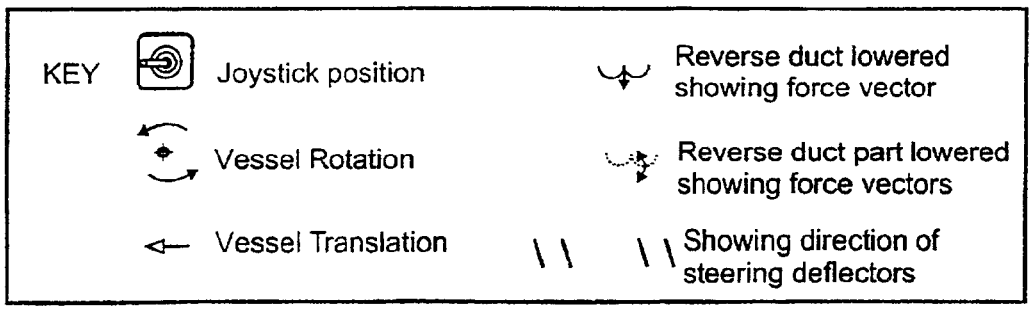

FIG. 1 is a schematic diagram showing two waterjet propulsion units 9 for a vessel and elements of possible control systems according to the invention. The waterjet units are typically placed port and starboard at the stem of the vessel. Three, four or possibly more units may be controlled together. Each unit has a housing containing a pumping unit 11 driven by an engine 10 through a driveshaft 12, a steering deflector 13 and a reverse duct 14. In this case the reverse ducts are each of a type that feature split passages to improve reverse thrust and affect steering thrust to port or starboard when the duct is lowered into the jet stream. The steering deflectors pivot about generally vertical axes 15 while the reverse ducts pivot about generally horizontal axes 16 independently of the deflectors. Actuation of the throttle, steering deflector and reverse duct of each unit is caused by signals received through control input ports 17, 18, 19 respectively.

constant compass heading. FIG. 2 also shows four rotations 3,4,5,6 in which the vessel turns to port or starboard about a point in the bow and to port or starboard about a point in the stern respectively. Manoeuvres resulting from operation of the joystick 21 to position the reverse ducts and operation of the helm to position the steering deflectors are shown, in each case with reference to a key. The steering deflectors are actuated in synchronism while the reverse ducts are operated in synchronism or differentially as summarised in the table below. Virtually any movement of the vessel may be achieved by a combination of these basic manoeuvres. The control system is intended to allow an operator to use the joystick and/or other controls in a simple intuitive fashion to cause movement of the vessel.

TABLE 1

SUMMARY OF 8 BASIC VESSEL MANOEUVRES

| | | Port Jet | | Starboard Jet | |
|---|---|---|---|---|---|
| No. | Type of manoeuvre | Reverse Duct | Steering Deflector | Reverse Duct | Steering Deflector |
| 1 | Translation-ahead | Up | Centre | Up | Centre |
| 2 | Translation-astern | Down | Centre | Down | Centre |
| 3 | Rotation about bow-port | Zero Speed | Port | Zero Speed | Port |
| 4 | Rotation about bow-stbd | Zero Speed | Stbd | Zero Speed | Stbd |
| 5 | Rotation about stem-port | Down | Centre | Up | Centre |
| 6 | Rotation about stem-stbd | Up | Centre | Down | Centre |
| 7 | Translation-port | Down | ½ Stbd | Up | ½ Stbd |
| 8 | Translation-stbd | Up | ½ Port | Down | ½ Port |

The control system in FIG. 1 includes a range of possible components 20 located on the vessel for manual use by an operator. Various components may be selected for an entirely new control system, or added to upgrade an existing system as required in a particular embodiment. A dual axis joystick 21, or other controller having two or perhaps more degrees of freedom, is generally provided for operation of the reverse ducts and possibly also the throttle. A throttle control lever 22 may be provided where this function is not included with the joystick. The lever typically allows independent or joint actuation of the throttle on each unit. Steering input is generally provided manually by way of a steering lever or joystick 23 or a helm wheel 24 having a single degree of freedom. Steering functions are normally actuated independently of the joystick 21 but when manoeuvring sideways may be actuated automatically according to operation of the joystick.

Various other components are also generally provided in a control system such as shown in FIG. 1. Each of the manual controls are usually connected through a panel module 30 via an interface module 32 to at least one actuator module 31. A number of modules may be linked as required depending on the number of waterjet units 9. A display may also be included, in the panel module 30 to provide control status information for the operator. The modules interpret manual operation of the components 20, such as x,y orientation of the joystick 21 or angular orientation of the wheel 24, and generate actuation signals for the waterjet units which are input through ports 17, 18, 19.

FIG. 2 shows eight basic manoeuvres of a vessel which may be enabled by a control system having a dual axis controller 21 according to the invention. These include four translations 1,2,7,8 in which the vessel moves ahead, astern, to port or to starboard respectively, while maintaining a In one preferred embodiment a control system having a joystick 21 can be used to replace a relatively cumbersome combination of single levers, with or without a separate throttle control. Moving the joystick ahead or astern synchronises the reverse and throttle demands and the effect is the same as operating a vessel with a single waterjet in manoeuvres 1,2. Moving the joystick transversely controls the port and starboard waterjets to produce differential thrust. One jet produces ahead thrust with the reverse duct raised while the other produces astern thrust with the reverse duct lowered. This rotates the vessel about the stern in manoeuvres 5,6 in a way which is preferably arranged to occur in accord with the direction of movement of the joystick. Turning the helm to counteract the rotation causes the vessel to translate sideways in manoeuvres 7,8. There is no requirement to change operating modes between manoeuvring and traveling at speed as the action of the joystick and helm remain the same throughout.

Figure 3:
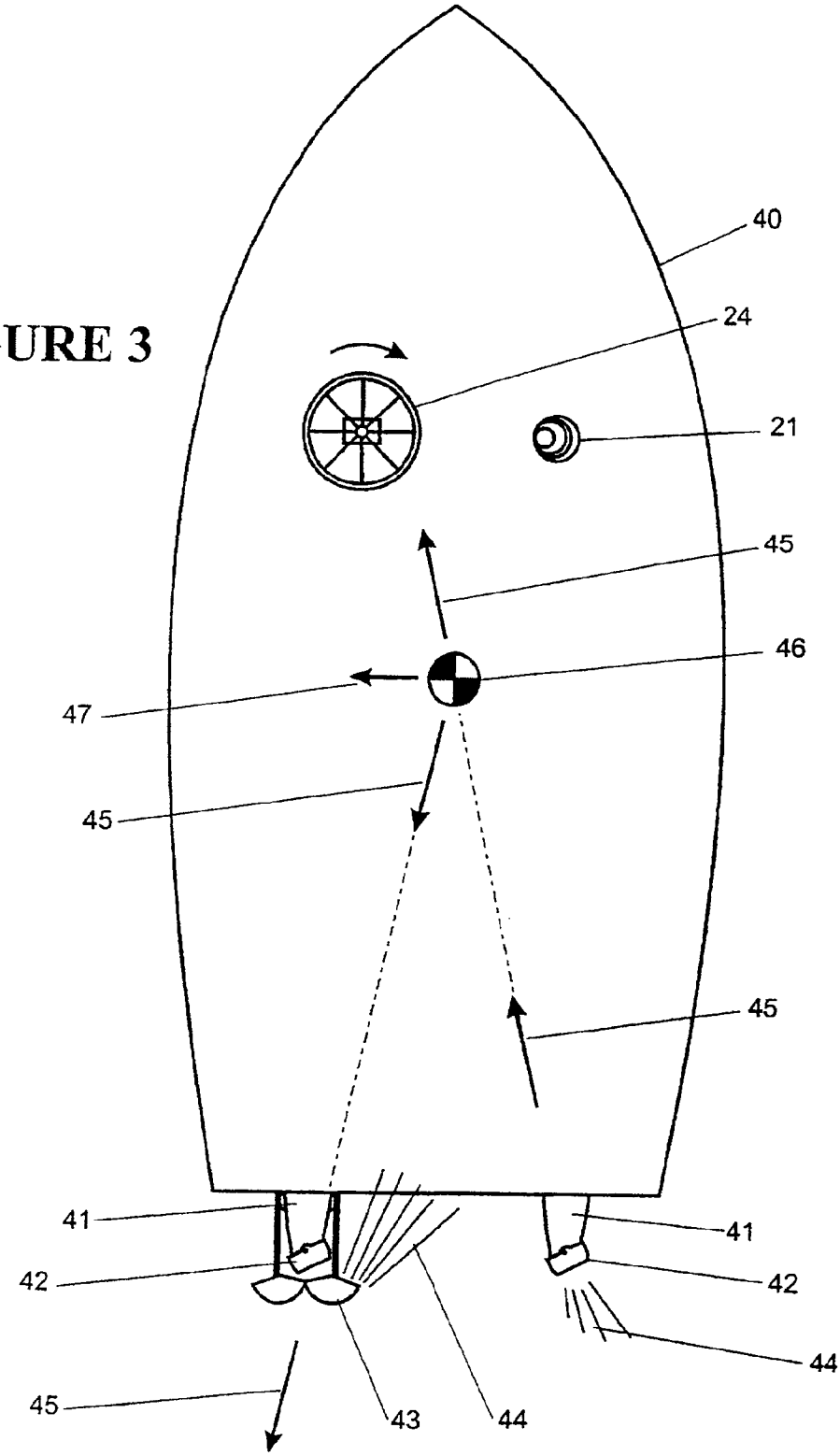
FIG. 3 illustrates a sideways manoeuvre to port for a twin unit system according to the invention.

FIG. 3 schematically shows a vessel 40 with a twin waterjet arrangement and a manual control system according to the invention. A sideways manoeuvre to port is in progress, such as manoeuvre 7 indicated in FIG. 2. Nozzles 41, steering deflectors 42 and one of the reverse ducts 43 are shown at the stern of the vessel to indicate the port and starboard waterjets. The reverse duct on the starboard waterjet is not positioned to deflect the water flow from that jet and has been omitted from view. A dual axis joystick 21 and wheel helm 24 are shown forward on the vessel to indicate the manual control system. The joystick has been pushed to port by the operator and the wheel has been turned to starboard. This produces jet streams 44 from the waterjets and consequently thrust vectors 45. The net sideways force acts at a point 46 towards the centre of the vessel represented by a thrust vector 47.

Figure 4:
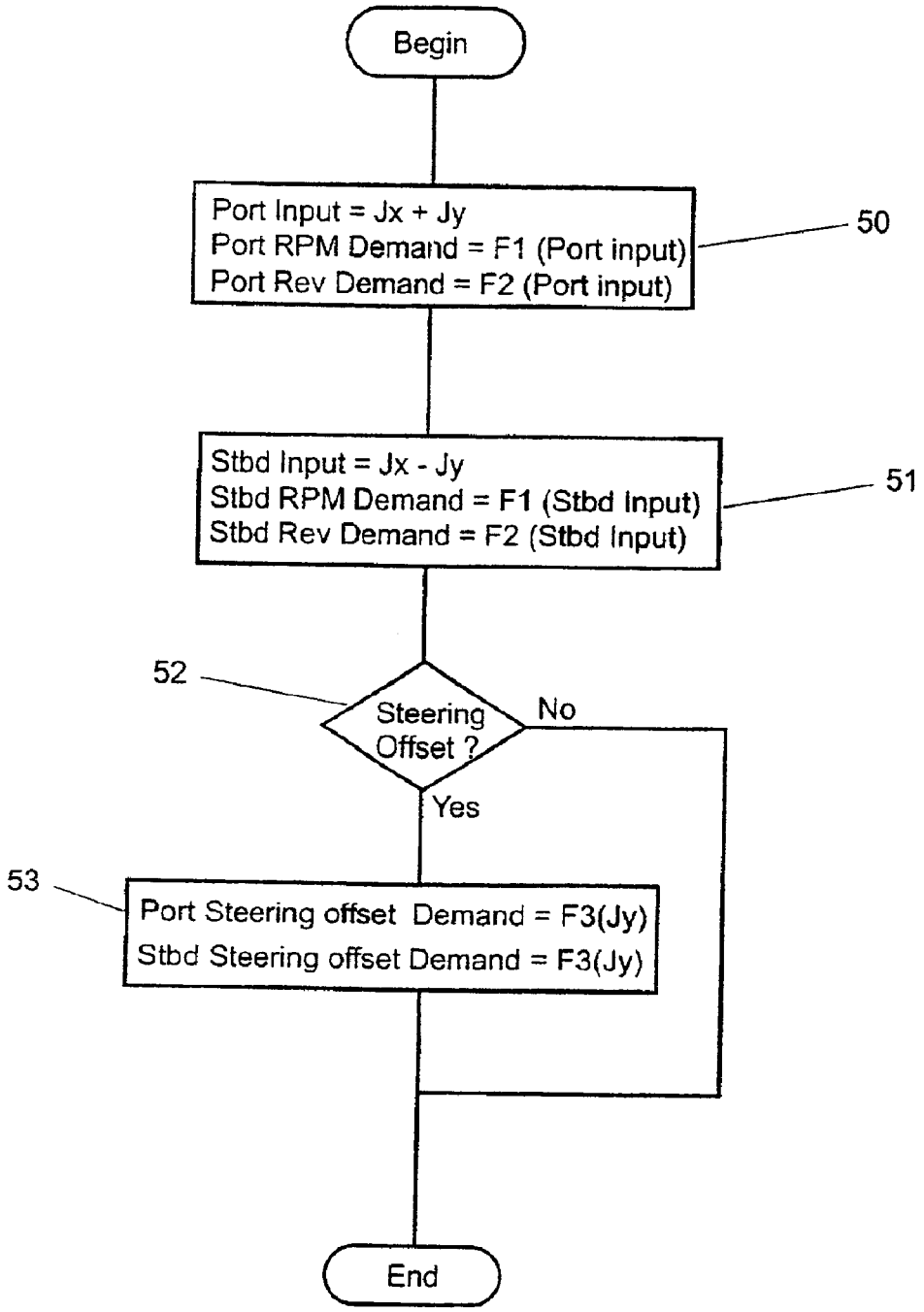
FIG. 4 is a flowchart showing operation of the controls when actuating the propulsion units.

FIG. 4 outlines a routine followed by software in the panel module 30 when receiving input from the manual controls. The module is continually monitoring x,y orientation of the joystick 21 which is generated as a pair of signals Jx, Jy. A signal representing the orientation of the helm has not been shown. In step 50 the module determines demands for port throttle and reverse using functions F1 and F2. In step 51 the module determines demands for starboard throttle and reverse. The port and starboard waterjet units are actuated accordingly through demands sent to the actuator modules 31.

In one preferred embodiment the control system includes a steering offset which may be initiated in step 52 of FIG. 4. This actuates the waterjet units automatically to create sideways translation of the vessel in manoeuvres 7,8 as if the helm had been used to counteract rotation as described above. Step 53 determines the steering offset demand for both port and starboard deflectors according to the y orientation of the joystick 21.

Figure 5:
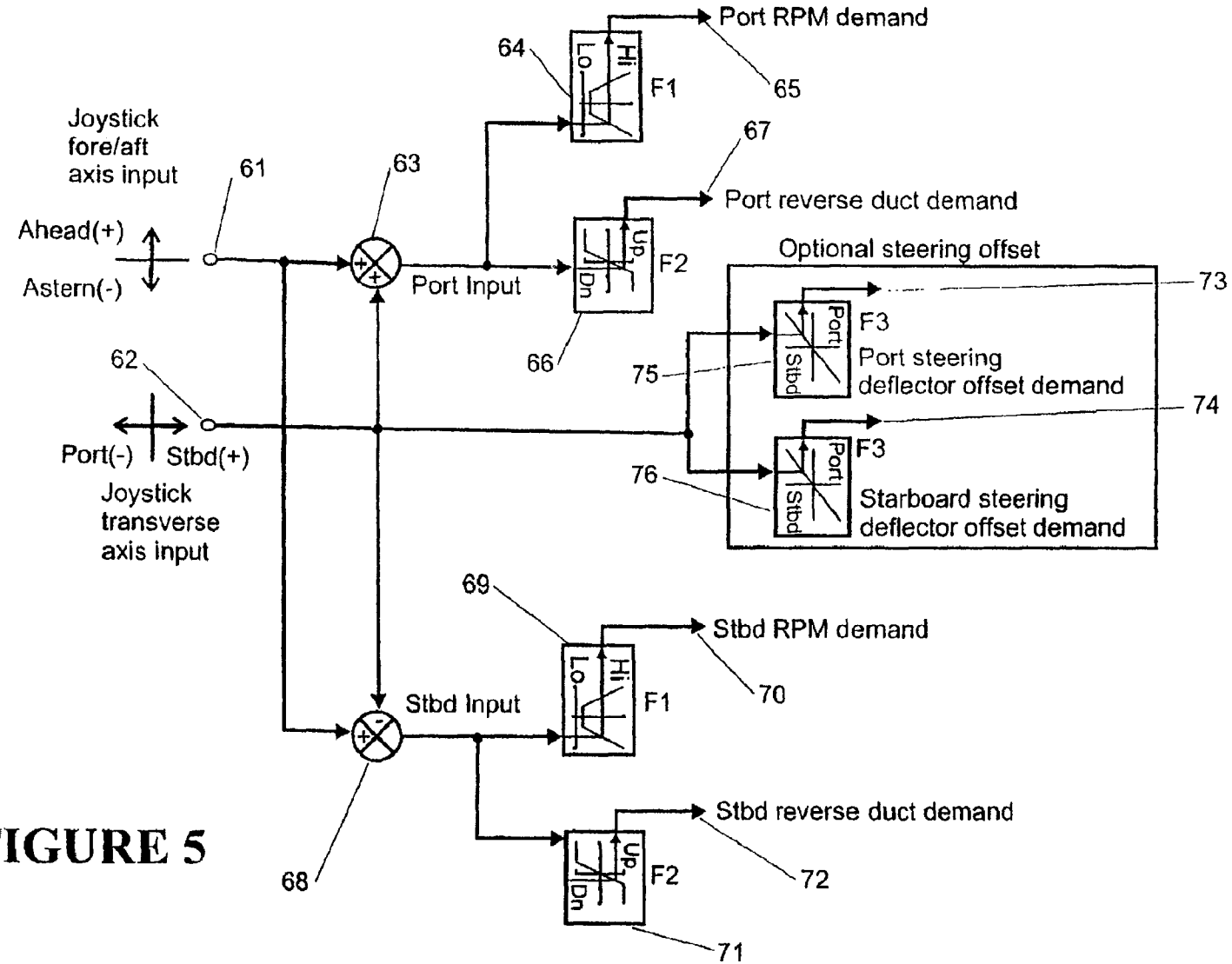
FIG. 5 shows details of the derivation of waterjet actuator signals from joystick signals.

FIG. 5 shows the functionality of the control system, for example the module 30 shown in FIG. 1, and particularly the derivation from the joystick signals of the actuator signals used to control the waterjets. FIG. 5 shows various functions as provided by discrete units but in a preferred embodiment the functions are provided by software equivalents. The control system interprets the position of the manually operated controls, in this case the xy orientation of a dual axis joystick, and generates actuation signals for the engine throttles, steering deflectors and reverse ducts. The joystick provides, to input port 61, an Ahead/Astern signal (Jx in FIG. 4) which signal is indicative of the position of the joystick on the fore and aft axis. The joystick also provides, to input port 62, a Port/Starboard signal (Jy in FIG. 4) which signal is indicative of the position of the joystick on the transverse axis.

The Ahead/Astern signal and the Port/Starboard signal are summed in an addition module 63 which outputs the summation result as a Port Input value. A Port RPM Demand signal, provided at output port 65, is derived from the Port Input value by a function module 64 with an input/output function F1 that provides an increase in the Port RPM Demand signal, from an initial low RPM or 'engine idle' value, as the modulus, or absolute value, of the summation result increases above a predetermined threshold. In the system shown in FIG. 1, the Port RPM Demand signal is applied to input port 17 of the throttle control for the port engine 10.

A Port Reverse Duct Demand signal is provided at output port 67. The Port Reverse Duct Demand signal is derived from the Port Input value (resulting from the summation of the Ahead/Astern and Port/Starboard signals) by a function module 66 with an input/output function F2 that provides an increase in the Port Reverse Duct Demand signal as the summation result increases, up to predetermined maximum values of positive and negative Port Reverse Duct Demand signals. In the system shown in FIG. 1, the Port Reverse Duct Demand signal is applied to input port 19 for controlling the port reverse duct 14.

The Port/Starboard signal is subtracted from the Ahead/Astern signal in subtraction module 68 which outputs a Starboard Input value. A Starboard RPM demand signal, provided at output 70, is derived from the Starboard Input value in a function module 69 with an input/output function F1 that provides an increase in the Starboard RPM demand signal, from an initial low RPM or 'engine idle' value, as the modulus, or absolute value, of the subtraction result increases above a predetermined threshold. In the system shown in FIG. 1, the Starboard RPM demand signal is applied to input port 17 of the throttle control for the starboard engine 10.

A Starboard Reverse Duct Demand signal is provided at output port 72. The Starboard Reverse Duct Demand signal is derived from the Starboard Input value (resulting from the subtraction of the Ahead/Astern signal from the Port/Starboard signal) by a function module 71 with an input/output function F2 that provides an increase in the Starboard Reverse Duct Demand signal as the subtraction result increases up to predetermined maximum values of positive and negative Starboard Reverse Duct Demand signals. In the system shown in FIG. 1, the Starboard Reverse Duct Demand signal is applied to input port 19 for controlling the starboard reverse duct 14.

The control system may also include output ports 73, 74 at which Port and Starboard Steering Deflector Offset Demand signals are respectively provided. As shown in FIG. 5, Port and Starboard Steering Deflector Offset Demand signals are independently derived from the Port/Starboard joystick signal in respective function modules 75, 76 each having a directly proportional input/output function F3. In the system shown in FIG. 1, the Port and Starboard Steering Deflector Offset Demand signals are applied to respective input ports 18, in addition to the steering demand signals generated from the helm control, for controlling the port and starboard steering deflectors 13.

What is claimed is:

1. A waterjet propulsion system for a water-borne vessel, including:

port and starboard waterjet propulsion units, thrust steering means associated with the port waterjet propulsion unit(s) and thrust steering means associated with the starboard waterjet propulsion unit(s) for deflecting the waterjets from the propulsion units for steering the vessel, which thrust steering means are linked for common steering movement together, thrust reverse means associated with the waterjet propulsion units for reverse deflecting the waterjets from the propulsion units and which thrust reverse means are mounted independently of the thrust steering means, first control means operable to actuate the thrust reverse means, and responsive within a first degree of freedom to actuate the thrust reverse means to cause common deflections of thrust for the port and starboard propulsion units and within a second degree of freedom to actuate the thrust reverse means to cause different deflections of thrust for the port and starboard propulsion units; and second control means operable to control the thrust steering means.

2. A system according to claim 1 wherein the first control means is also operable to control the power levels of the propulsion units.

3. A system according to claim 1 wherein the second-control means is responsive within one degree of freedom to cause rotational movement about a point towards the bow of the vessel.

4. A system according to claim 1 wherein the first and second control means are responsive together within respective degrees of freedom to cause port or starboard translational movement of the vessel.

5. A system according to claim 1 comprising steering deflection offset means operably connected to said first control means for automatically effecting partial deflection of the thrust steering means when said first control means is operated within the second degree of freedom.

6. A system according to claim 1 wherein the thrust steering means maintains a common deflection of the thrust for the propulsion units during translational movements transverse to the vessel.

7. A system according to claim 1 wherein the thrust steering means maintains a common deflection of thrust for the propulsion units during all movements of the vessel.

8. A system according to claim 1 wherein the first control means includes a multiple axis joystick.

9. A system according to claim 1 wherein the second control means includes a helm wheel or single axis joystick.

10. A system according to claim 1 wherein the thrust reverse means includes deflector buckets which are lowerable into the waterjets from the propulsion units for reverse deflecting the waterjets.

11. A system according to claim 1 wherein the thrust reverse means includes deflector buckets which are lowerable into the waterjets from the propulsion units for reverse deflecting the waterjets and wherein the deflector buckets are split or double cavity deflector buckets.

12. A system according to claim 1 wherein the thrust steering means include a deflector nozzle associated with the waterjet propulsion units.

13. A system according to claim 1 wherein the thrust steering means include deflector nozzles associated with the waterjet propulsion units, which deflector nozzles are mechanically limited for said common steering movement together.

* * * * *

UNITED STATES PATENT AND TRADEMARK OFFICE

CERTIFICATE OF CORRECTION

PATENT NO. : 6,865,996 B2
DATED : March 15, 2005
INVENTOR(S) : John Robert Borrett It is certified that error appears in the above-identified patent and that said Letters Patent is hereby corrected as shown below:

Title page,
Item [63], Related U.S. Application Data,
"Continuation of application No. PCT/NZ00/00222, filed on Sep. 11, 2000" should read -- Continuation of application No. PCT/NZ00/00222, filed on Nov. 9, 2000. --.

Signed and Sealed this

Sixteenth Day of May, 2006

JON W. DUDAS
*Director of the United States Patent and Trademark Office*